United States Patent [19]

Kniepkamp et al.

[11] 4,038,898

[45] Aug. 2, 1977

[54] SYSTEM FOR PRODUCING CHORUS EFFECT

[75] Inventors: Alberto Kniepkamp, Arlington Heights; Douglas Moore, Niles, both of Ill.

[73] Assignee: Norlin Music, Inc., Lincolnwood, Ill.

[21] Appl. No.: 554,727

[22] Filed: Mar. 3, 1975

[51] Int. Cl.[2] ..... G10H 1/02

[52] U.S. Cl. ..... 84/1.24; 84/1.27; 84/DIG. 1; 84/DIG. 4

[58] Field of Search .... 84/DIG. 1, DIG. 4, DIG. 19, 84/DIG. 27, 1.24, 1.27; 179/1 J, 1 M; 307/222, 223, 269; 328/69, 155; 331/55, 56, 172

[56] References Cited

U.S. PATENT DOCUMENTS

| | | | |
|---|---|---|---|
| 3,000,252 | 9/1961 | Wayne, Jr. | 84/DIG. 1 |
| 3,325,581 | 6/1967 | Young | 84/1.27 |
| 3,372,225 | 3/1968 | Leslie | 84/1.24 |
| 3,798,558 | 3/1974 | Kopperschmidt et al. | 328/155 |
| 3,866,505 | 2/1975 | Adachi | 84/1.01 |
| 3,902,396 | 9/1975 | Hiyoshi | 84/1.24 |

*Primary Examiner*—E. S. Jackmon

[57] ABSTRACT

A circuit for producing a chorus effect in an electronic musical instrument. The circuit includes N separate channels, where N is an integer greater than one, with each channel having an analog delay line to which a tone signal is applied. Each delay line frequency modulates the applied tone signal at a subaudio rate in response to changes in the frequency of clock pulses applied to the delay lines. The delay variations in one delay line are out of phase with the delay variation in every other delay line by a selected amount which is normally 360°/*N*. Clock pulses are generated by means including a nonlinear circuit to compensate for the nonlinearity in the frequency interval between tones in the musical scale. The outputs from the delay lines after filtering of the clock frequency components are utilized to produce the desired chorus effect output from the instrument. Each of these outputs is applied through a separate voltage controlled amplifier (VCA) with a common control voltage being utilized for all of said VCA's. The magnitude of this control voltage is determined by the amount of light from a light source which impinges on a photo-resistive device controlled by a mask positioned between these elements.

34 Claims, 6 Drawing Figures

Fig. 1.

SYSTEM FOR PRODUCING CHORUS EFFECT

BACKGROUND

1. Field of the Invention

This invention relates to electronic musical instruments and more particularly to a circuit for producing a chorus or ensemble effect in such an instrument.

2. The Prior Art

Electronic musical instruments such as electronic organs, electric pianos, and various special purpose electronic instruments are designed to simulate the sound of a particular musical instrument, or to simulate the sound of one of a selected group of musical instruments. In recent years, a chorus or ensemble effect has been added to some of these instruments which permits a single instrument to simulate the sound of a group of instruments such as, for example, a string ensemble or string section of an orchestra, or the brass section of an orchestra. One existing system for providing this effect employs three independent tone oscillators plus two vibrato oscillators for each note of the scale. While the ensemble effect obtainable with this circuit is excellent, the cost of this system is sufficiently high so as to severely restrict its use.

Less expensive systems employ a standard organ or other electronic musical instrument tone generator system and apply the tone signal to a selected number (normally three) of separate delay line channels. Each of these channels contains an analog delay line through which the tone signal is applied. The clock or stepping pulses for each of the delay lines are obtained from circuitry which includes a separate voltage controlled oscillator for each channel. The control voltage input to each of these oscillators is out of phase with the control voltage inputs to each of the other oscillators.

While these systems are substantially less expensive than the first system indicated above, there is a predetermined rhythmic relationship between the tone on the various channels which results in a sound which is less aesthetically similar to that of a true ensemble than that obtainable with the first system indicated above. Another problem with these systems stems from the fact that the output from each voltage controlled oscillator varies linearly with changes in the applied control voltage while the frequency intervals between tones of the musical scale are nonlinear (exponential). Since the control voltage for the oscillator for each channel is normally formed of a low frequency sine wave having a higher frequency tremolo-inducing sine wave superimposed thereon, the nonlinearity indicated above may result, among other things, in undesirable surges in the tremolo signal rather than in a uniform, smooth tremolo. Because of the components utilized, these prior art systems also suffer from possible stability problems. Their range of control is also limited, and they are still relatively complex and expensive. Finally, existing systems utilize only a single tone signal in producing the chorus effect and are thus able to produce a chorus effect having only a single voice or other tonal characteristic, such as, for example, only a string ensemble sound. These systems are not capable of reproducing the effect of an ensemble made up of a number of different musical instruments.

A need therefore exists for a simple, inexpensive system for providing a high quality chorus or ensemble effect in an electronic musical instrument. In particular, such a system should provide a substantial range of control so as to be adapted for introducing some random variation in phase shift in the various channels, providing a truer chorus effect, and should also be capable of compensating for the various nonlinearities indicated above so as to provide, among other things, a smoothly modulated audio signal output from the delay line, including a relatively smooth tremolo output. Such a system should utilize components which have good frequency stability so as to be capable of providing a uniform output under varying environmental conditions and over extended periods of time, and should use a minimum number of components so as to be as simple and inexpensive as possible. Finally, the improved system should be adapted to simultaneously utilize tone signals having different tonal characteristics so as to be capable of reproducing the sound of an ensemble made up of different musical instruments.

SUMMARY OF THE PRESENT INVENTION

This invention thus provides a circuit for producing a chorus effect in an electronic musical instrument. The circuit includes N separate channels, where N is an integer greater than one, each of which channels contains an analog delay line. Tone signals from a tone signal source are applied as an input to each of the delay lines. A means is also provided for generating clock pulses constantly varying in frequency to modulate the delay in each delay line, the clock pulse variations for the delay line of each channel being out of phase with those of each other channel by a selected amount which, for a preferred embodiment of the invention, is (360°/N). The means for generating the clock pulses includes first and second N stage counters, means for stepping the first counter at a first predetermined subaudio frequency, and for stepping the second counter at a second frequency, the second frequency being several times greater than the first frequency, means for combining the output from each stage of the first counter with the output from a selected stage of the second counter and applying each of said combined outputs to a single line, a filter means for each channel, a voltage controlled oscillator for each channel, means for applying the combined output on each of said lines through a different one of the filter means to control the output frequency of the corresponding oscillator, and means for utilizing the output from each oscillator to produce the clock pulses to drive the corresponding delay line. For a preferred embodiment, the filter means provided for each channel converts the combined output applied thereto, which output is a low frequency rectangular wave having a higher frequency rectangular wave superimposed thereon, each of said waves having a roughly (100%/N) duty cycle, into a low frequency sine wave having a higher frequency sine wave superimposed thereon. This signal is applied to a nonlinear circuit which includes means for compensating for the nonlinearity in the amount of delay necessary to smoothly frequency modulate an audio signal by equal musical intervals on each side of the tone signal frequency. The output from the oscillator of each channel is a relatively high frequency triangular wave. Each channel includes means for utilizing only the peaks of this wave to produce two clock pulses per cycle to the delay line which pulses are non overlapping and 180° out of phase with each other.

Finally, for the preferred embodiment, the instrument has a player operated amplitude control means and a separate voltage controlled amplifier (VCA) for each channel, the output from each delay line being applied to the corresponding VCA. A means is provided for applying a common control voltage to all of the VCAs. This means includes a light source, a photoresistive device positioned to have light from the source impinged thereon, means responsive to the player operated amplitude control means for modulating the amount of light impinging on the photoresistive device, and means responsive to the amount of light impinging on the photoresistive device for controlling the common control voltage.

For an alternative embodiment of the invention, the source of tone signals produces at least two separate tone signals which signals have different tonal characteristics. These separate tone signals are applied to different ones of the delayed lines resulting in an output from the instrument which reproduces the effect on an ensemble made up of different musical instruments.

The foregoing and other objects, features advantages of the invention will be apparent from the following more particular description of preferred embodiments of the invention as illustrated in the accompanying drawings.

GENERAL CIRCUIT DESCRIPTION

Figure 1:
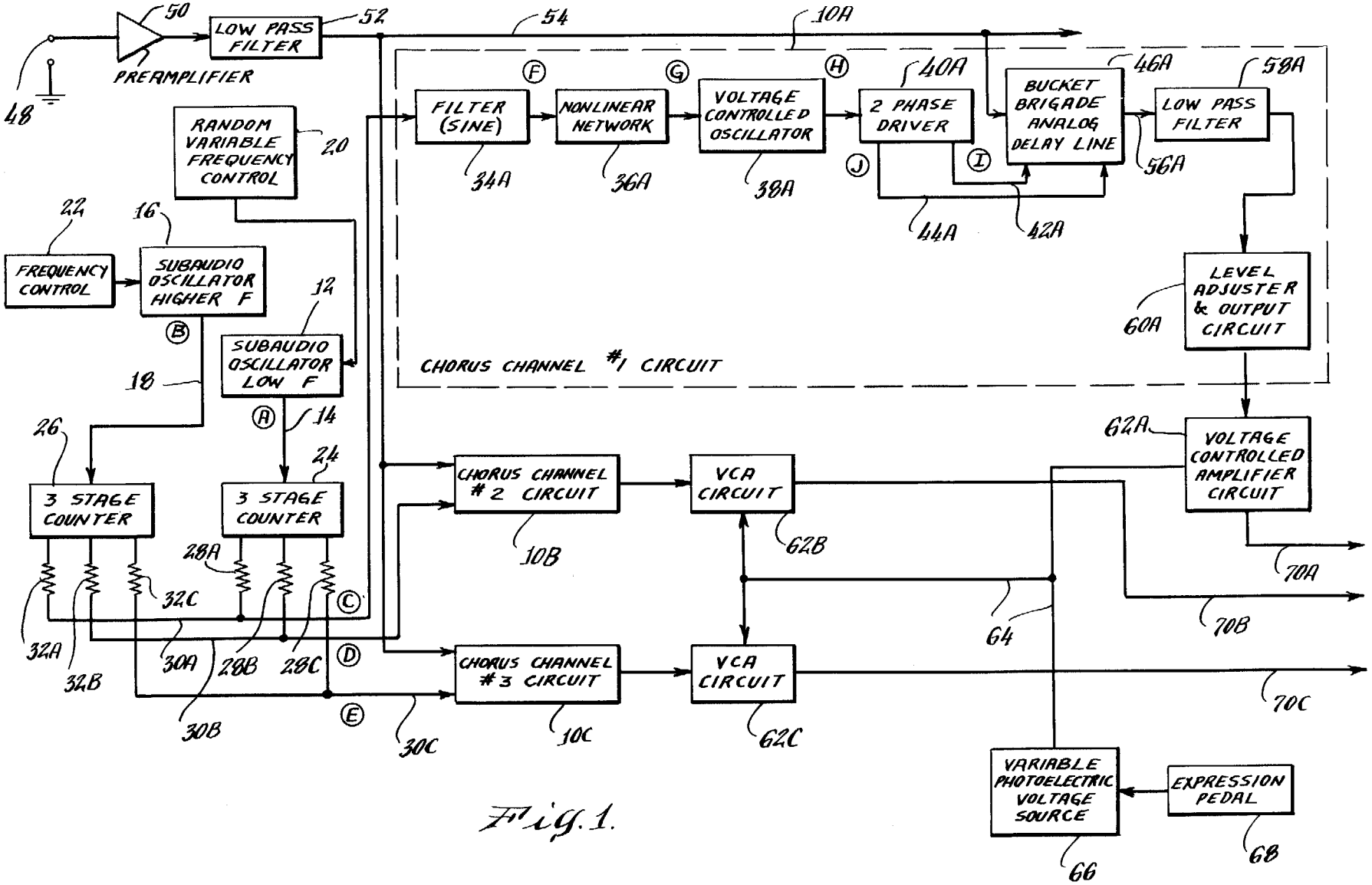
FIG. 1 is a schematic block diagram of a chorus effect generating circuit of a preferred embodiment of the invention.

Referring now to FIG. 1, it is seen that the chorus effect generator for a preferred embodiment of the invention includes three chorus channel circuits (10A, 10B and 10C.) Since these three circuits are identical, only chorus channel one is shown in detail in FIG. 1, it being understood that, unless otherwise indicated, what is said for chorus channel one circuit 10A, will apply equally to the other two chorus channel circuits. The circuit of FIG. 1 also includes two subaudio frequency oscillator circuits, a lower frequency oscillator 12, which may for example generate output pulses on line 14 at a rate of two pulses per second (see Line A of FIG. 5), and a higher frequency oscillator 16 which may, for example, generate output pulses on line 18 at a rate of twenty pulses per second (see line B of FIG. 5.) Thus, oscillator 16 operates at a frequency several times greater than oscillator 12, the ratio of the two oscillators being roughly ten to one for a preferred embodiment of the invention. The instantaneous frequency of oscillator 12 is controlled by random variable frequency control 20, this circuit permitting a specific oscillator frequency for the oscillator 12 to be selected, but permitting for random variations in the oscillator frequency around the selected frequency for purposes which will be described in greater detail later. A frequency control 22 is also provided for oscillator 16, this circuit permitting selection of the oscillator frequency for oscillator 16. While, in order to provide maximum flexibility in selection of the oscillator frequencies, independent oscillator circuits, each having a separate frequency control, are shown for the preferred embodiment of the invention, where such flexibility is not required, a less expensive circuit can be obtained by utilizing a single oscillator set, for example, to the higher frequency of oscillator 16, and passing the oscillator signals on output line 18 from this oscillator through a suitable divider to obtain the lower frequency pulses for line 14.

The pulses on lines 14 and 18 are respectively applied as stepping inputs to standard three stage ring counters 24 and 26. These counters distribute the oscillator pulses to three separate outputs each presenting a frequency which is equal to the oscillator frequency divided by three and separated by 120° from the other outputs. The output from each stage of counter 24 is applied through a relatively high resistance 28 to a corresponding line 30. The output from the corresponding stage of counter 26 is applied through a relatively low resistance 32 to each line 30. Thus, the outputs from the first stage of each of the counters are summed on line 30A, the outputs from the second stage of each counter are summed on line 30B, and the outputs from the third stage of each counter are summed on 30C. Because of the differences in the resistance values of resistors 28 and 32, the amplitude of the higher frequency components appearing on each of these lines is significantly greater than the amplitude of the lower frequency components. The phase of both the high frequency and the low frequency components appearing on each of the line 30 is 120° degrees out of phase with the outputs of the same frequency appearing on each of the other two lines. Further, since each output from each counter is high only one third of each counter cycle, each of the components appearing on each line 30 has only a one-third or 33⅓% duty cycle. The signals appearing on lines 30A, 30B, and 30C are shown on lines C, D, and E respectively of FIG. 5.

The one-third duty cycle signals on each of the lines 30 are applied as a control input to the corresponding chorus channel circuit 10. Referring now to circuit 10A, the signal on line 30A is applied as an input to a filter 34A. Filter 34A has a high Q and is tuned substantially to one-third the frequency of oscillator 12 (i.e., the frequency of the low frequency component on line 30A.) This filter is thus operative to convert the signal applied thereto (see line C of FIG. 5) into a sine wave at the frequency of, and substantially in phase with, the lower frequency component of the signal on line 30A, this sine wave having a higher frequency sine wave, substantially at the frequency of and in phase with the higher frequency component of the signal on line 30A superimposed thereon. (By definition, each sine wave has a substantially 50% duty cycle.) Because of the high Q of the filter and its tuning, the amplitude of the low frequency component is accentuated by the filter and the amplitude of the higher frequency component is attenuated. The resultant wave at the output of filter 34A is shown on line F of FIG. 5. Corresponding filters in circuits 10B and 10C have outputs which are the same as that shown on line F, but 120° out of phase therewith (and with each other.)

Because of the nonlinearity problems previously discussed, the output from the filter is passed through a nonlinear network 36A which converts the output from the filter into a wave having distortion designed to compensate for those nonlinearities. The output signal from nonlinear network 36A for the preferred embodiment of the invention is shown on line G of FIG. 5. The nonlinear networks for circuits 10B and 10C would have the same outputs as that shown on line G, but would be 120° out of phase therewith (and with each other).

Figure 5:
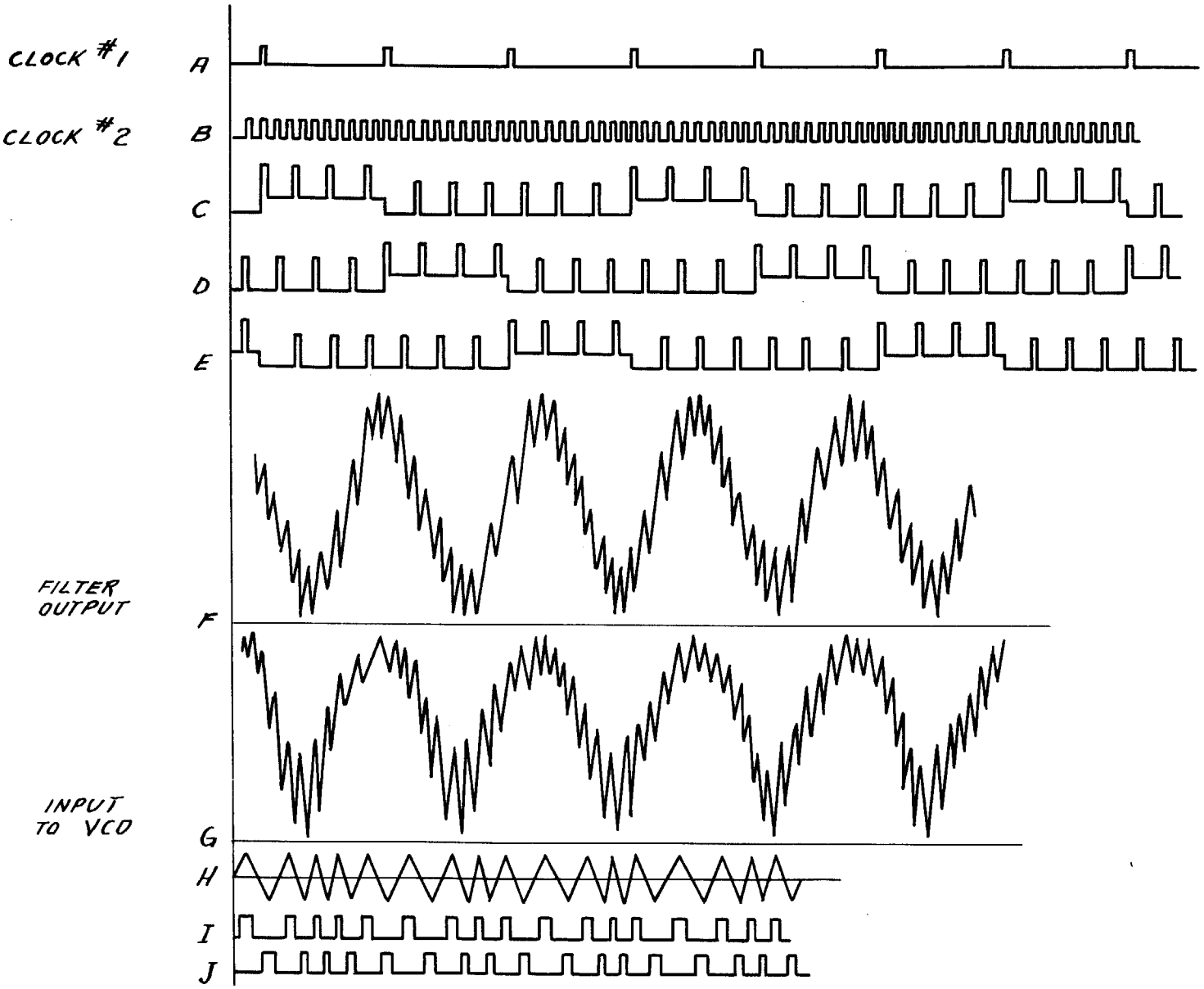
FIG. 5 is a diagram illustrating waveforms appearing at various points in the circuit shown in FIG. 1.

The output from the nonlinear network is applied as a control input to a voltage controlled oscillator (VCO) 38A. The output from the VCO is a triangular wave, the frequency of which varies as a function of the voltage appearing at its input. The frequency of the VCO is, however, relatively high compared to oscillator 12 and 16, varying for a preferred embodiment of the invention around a base of roughly 40,000 CPS. The output from the VCO is shown on line H of FIG. 5. It should be noted that since the frequency of the VCO is roughly 2,000 times that of oscillator 16, it is not possible to use the same scale for line H as was used for lines A through G of this figure. Thus, while there is no specific relationship between the signal on line H and that on line G as shown in FIG. 5, it should be understood that, in fact, the frequency of the signal on line H increases as the voltage of the signal on line G decreases, and the frequency of the signal on line H decreases as the amplitude of the signal on line G increases.

The output signal from the VCO is applied to a two-phase driver 40A, this circuit converting the triangular wave output from the VCO into pulse trains on lines 42A and 44A, the pulses on these two lines being of the same polarity, non overlapping, and 180° degrees out of phase with each other regardless of the frequency of the output signal from the VCO.

The pulse signals on lines 42A and 44A are applied as clock inputs to a standard bucket brigade analog delay line 46A. The audio information input to delay line 46A is derived from a tone signal source 48 which may, for example, be the keyed outputs from the tone generator of any standard electronic organ, or other equivalent circuitry, this tone signal being applied to the delay line through a preamplifier 50 and a low pass filter 52. Filter 52 serves to eliminate undesired higher frequency harmonics from the signal. The signal on output line 54 from filter 52 is also applied as the information input to the bucket brigade analog delay line (not shown) of chorus channel number two circuit 10B and chorus channel number three circuit 10C. The delay line operates by sampling the incoming signal into consecutive pulses of an amplitude proportional to the instantaneous amplitude of the incoming signal at the time of sampling. These pulses are pushed step by step through the stages of the delay line by succeeding clock pulses and are delayed by a time directly proportional to the number of stages in the delay line and inversely proportional to the clock frequency. Delay lines of the type described above are well known in the art, such a delay line being described in detail in articles entitled "Bucket Brigade Electronics — New Possibilities For Delay Time Axis Conversion and Scanning" by F. I. J. Sangster and K. Teer, appearing in the IEEE Journal of Solid State circuits on June, 1969 at page and "MOS Analog Delay Line" by Roger A. Mao, Keneth R. Keller and Richard W. Ahrons appearing in the August, 1969 issue of the same Journal, on page 196.

The signal on output line 56A from delay line 46A is passed through a low-pass filter 58A which eliminates higher frequencies and recovers the sampled analog signal, through a level adjuster and output circuit 60A, this circuit not forming part of the present invention, to a voltage controlled amplifier (VCA) circuit 62A. The outputs from each of the chorus channel circuits 10B and 10C are applied to corresponding VCA circuits 62B and 62C respectively. A common control voltage for the VCA circuits 62 appears on output line 64 from variable photo-electric voltage source 66. The control voltage on line 64 is controlled, in a manner to be described shortly, by the position of a player operated volume control element on the instrument being played, this being an expression pedal 68 for an organ.

The outputs from the VCA's on the lines 70 may be combined and passed through a single output system and speaker; however, in order to achieve a true chorus effect, the outputs on lines 70 are preferably applied through separate output systems and speakers. Because of the different phasing in each channel for both the low frequency component and the higher frequency tremolo component of the control voltage used to generate the shift pulses for the channel's analog delay line, the output on each of the lines 70 is out of phase with the output on each of the other lines 70. If the speakers connected to each channel are slightly spaced from each other, a space modulated output is achieved which provides a true chorus-ensemble sound.

Further, control 20 permits for slight variations in the clock rate on line 14, and thus in the rate at which counter 24 is stepped. The variations introduced by the random variable frequency control 20 result in a variation in the way a given sound appears to move through the three channels (i.e., a variation in the rate of the space modulation), providing a less mechanical and thus truer ensemble sound.

DETAILED DESCRIPTION OF CIRCUITRY

Certain elements discussed above in connection with FIG. 1, are either standard off-the-shelf items or do not form part of the present invention and therefore need not be described in detail. Included among these elements are counters 24 and 26, VCO 38, preamplifier 50, low-pass filter 52, low-pass filter 58 and level adjuster and output circuit 60. Suitable circuitry for bucket brigade analog delay line 46 has been described above. The following is a more detailed description of elements suitable for use in the remaining circuits shown in FIG. 1.

Figure 2:
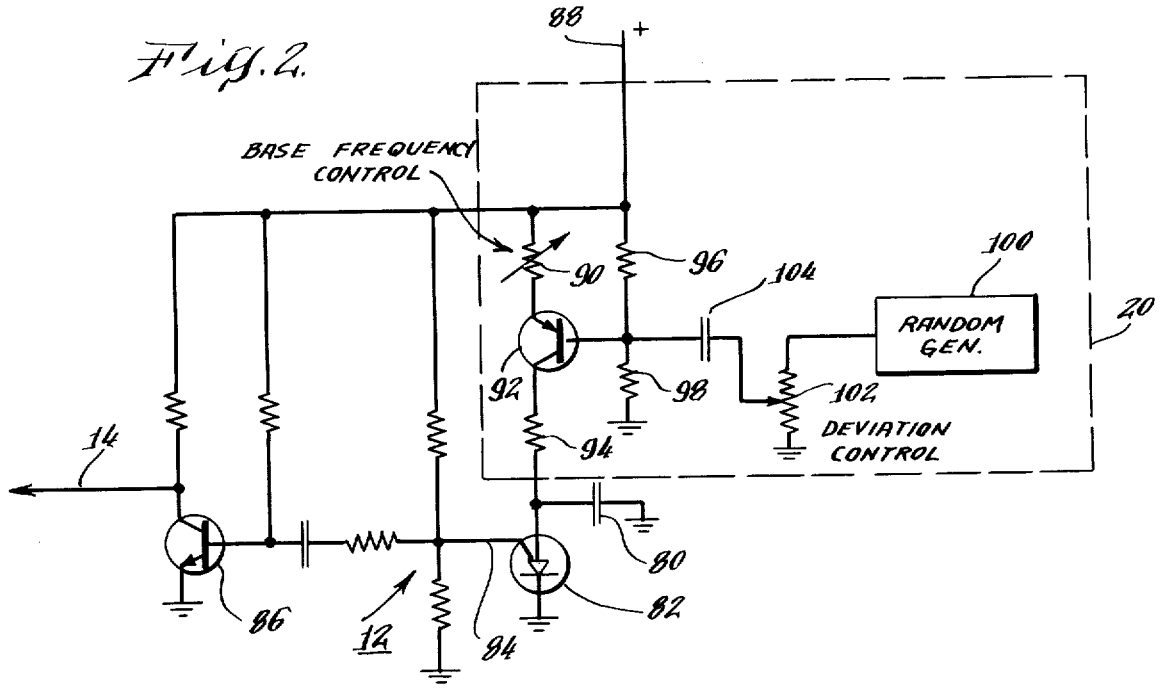
FIG. 2 is a semiblock schematic diagram of a subaudio frequency oscillator circuit suitable for use in the embodiment of the invention shown in FIG. 1.

Referring to FIG. 2, circuitry suitable for use as the low frequency oscillator 12 and the random variable frequency control 20 as shown. The Oscillator 12 consists of a capacitor 80 which is charged at a rate which is controlled by circuit 20. When the charge across capacitor 80 reaches a predetermined value, programable unijunction transistor 82 becomes momentarily conductive permitting capacitor 80 to discharge and causing a negative pulse to appear on output line 84 from the transistor 82. This pulse is inverted by transistor 86 causing a positive clock pulse to appear on output line 14.

The sequence of events described above is then cyclically repeated with capacitor 80 being charged during each cycle until the potential there across is again sufficient to render transistor 82 conductive permitting the capacitor to discharge and another pulse to be generated. It is thus seen that the rate at which pulses appear on line 14 is directly related to the rate at which capacitor 80 is charged. Capacitor 80 is charged from a source of positive potential 88 through a frequency control potentiometer 90, transistor 92 and resistor 94. Potentiometer 90 controls the base frequency of the oscillator. Transistor 92 controls the random variations about this base frequency, the resistance introduced by this transistor at any given time being determined by the potential applied to its base. This potential is controlled by a voltage divider consisting of resistors 96 and 98 and by a potential received from random generator 100 through deviation control potentiometer 102 and capacitor 104. Generator 100 may be any standard circuit which generates an output potential the magnitude of which varies randomly with time. Control 102 determines the magnitude of the deviations from the base frequency caused by variations in the potential from generator 100. When this potentiometer is in its highest position, relatively large ddeviations occur, while when this potentiometer is in its lowest position, the random deviations are eliminated completely. The rate at which the random deviations occur is determined by the rate at which the random values generated by generator 100 change.

Oscillator circuit 16 is identical to oscillator circuit 12, while frequency control 22 includes only a potentiometer similar to potentiometer 90 and a resistor 94 in the charging path. The value of the potentiometer and resistor for the circuit 22 are selected so as to provide the proper charging rate to obtain the desired output frequency from the oscillator 16.

Figure 3:
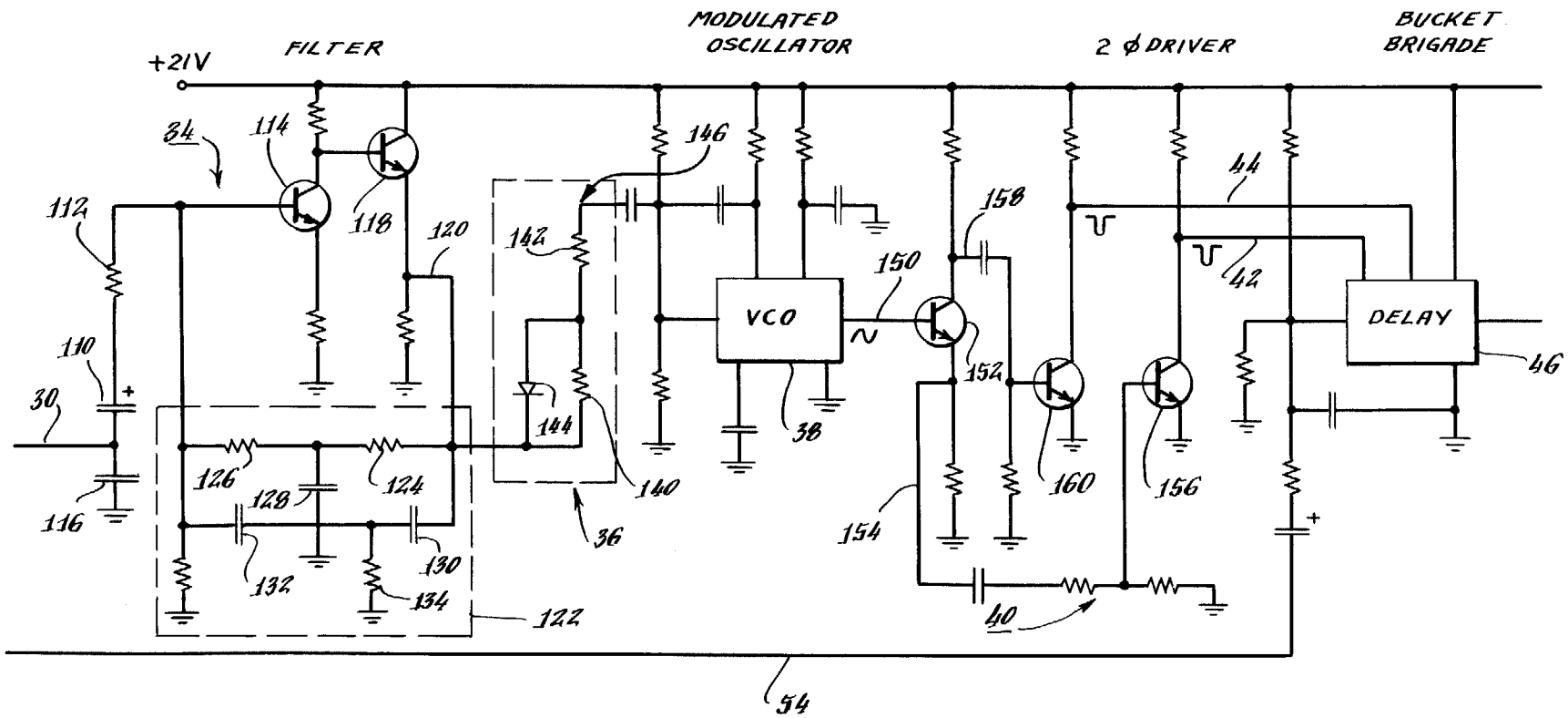
FIG. 3 is a semiblock schematic diagram of a filter, nonlinear network, voltage controlled oscillator, two phase clock driver, and bucket brigade analog delay line for a single channel suitable for use in the circuit shown in FIG. 1.

Referring now to FIG. 3, a filter 34, non-linear circuit 36, VCO 38, two-phase driver 40, and bucket brigade analog delay line 46 for a single channel 10 are shown in greater detail. Filter 34 is connected as a standard twin T active filter. The input to the filter on line 30 is passed through capacitor 110 and resistor 112 to transistor 114. High frequency components of the signal on line 30 are shunted to ground through capacitor 116, the value of this capacitor being substantially lower than that of capacitor 110. The output from transistor 114 is applied to emitter follower transistor 118. The output from transistor 118 on line 120, in addition to being applied as the input to nonlinear network 36, is also applied through a feedback circuit 122 to the input to transistor 114. Network 122 is in the form of a twin T network, resistors 124 and 126 with a shunt connection to ground through capacitor 128 between them forming the low-pass portion of this network, and capacitors 130 and 132 with a shunt connection to ground through resistor 134 between them forming the high-pass portion of the network. The values of the various components of network 122 are selected such that at some frequency, the impedance of the high pass path is equal to the impedance of the low-pass path at this frequency, the impedance of the network is maximum.

This frequency is roughly equal to one-third the frequency of oscillator 12, (i.e., the frequency of the low frequency component on line 30A). The amplitude of the feedback signal is such as to provide the desired high Q for the filter. Therefore, maximum gain occurs in filter 34 for the low frequency component of the signal on line 30 and the output waveform from the filter is substantially shown on line F of FIG. 5.

The nonlinear network 36 consists of a pair of resistos 140 and 142 connected in series, the value of resistance 140 being significantly greater than that of resistor 142, with resistor 140 being shunted by a diode 144. The diode is polarized so as to be conducting when the potential at point 146 is more positive then the potential on line 120 and to be nonconducting when the potential on line 120 is more positive than the potential at point 146. Thus, the impedance of the nonlinear network is greater when the potential on line 120 is increasing, being the sum of the impedances of resistors 140 and 142, and is less when the potential on line 120 is decreasing, being close to the impedance of resistor 142. The effect of the nonlinear network is thus to distort the output waveform from filter 34 so as to increase its rise time and decrease its fall time, also modifying the high frequency component so that its amplitude is greater for lower values of the low frequency component than it is for higher values of this component. The resulting output waveform, which is applied as a control voltage input to VCO 38, is shown on line G of FIG. 5. As indicated previously, this waveform is adapted to smoothly frequency modulate the audio signal applied to delay line 46 by equal musical intervals on each side of the tone signal frequency, resulting in a substantially uniform chorus (and tremolo) effect on the output from the instrument.

The nonlinear circuit described above is designed for a VCO 38 the output frequency of which is inversely proportional to the control voltage applied thereto (i.e., the frequency decreases as the voltage increases). If a VCO is utilized in which the output frequency is directly proportional to the applied control voltage (i.e., the frequency increases as the control voltage increases), then the nonlinear circuit would be modified so that the impedance of the nonlinear network is greater when the potential on line 120 is decreasing, and is less when the potential on line 120 is increasing.

VCO 38 may be any standard component adapted for providing the required function, as example of a suitable device being a type 566 I.C. function generator. The variable frequency triangular wave output from oscillator 38 on line 150 is applied to the input of two-phase driver 40. Driver 40 has a first transistor 152 to the base of which the signal on line 150 is applied. As the potential applied to line 150 increases, the output from the emitter of this transistor on line 154 becomes more positive. When this value exceeds a predetermined threshold, transistor 156 becomes conductive causing a drop in the potential on line 42. As a positive half cycle of the signal on line 150 decreases, the potential on line 154 similarly decreases, transistor 156 being cut off when the potential on line 154 drops below the predetermined threshold. When transistor 156 is cut off, the potential on line 42 returns to its higher quiescent potential. Thus, a negative pulse (i.e., a pulse of lower positive potential) appears on line 42 for the period of time that transistor 156 is conductive. Similarly, on the negative half cycle of the signal on line 150, output line 158 from the collector of transistor 152 becomes more positive, transistor 160 becoming conductive when this positive potential exceeds a predetermined threshold value. Transistor 160 becoming conductive causes a drop in the potential on line 44 which continues until, on the decay of the negative half cycle on line 150, the potential on line 158 drops below the conducting threshold for transistor 160. It is therefore seen that the pulses on lines 42 and 44 may be made as narrow as desired by selecting suitable threshold potentials for rendering transistors 156 and 160 conductive. In any event, so long as these transistors do not become conductive at the transition point between positive and negative half cycles on line 150, the pulses on lines 42 and 44 will be nonoverlapping regardless of the frequency of the signal on line 150. Driver 40 is thus operative to provide separate trains of pulses on lines 42 and 44 which trains are of the same polarity, are 180° out of phase with each other, and are non-overlapping regardless of the frequency of the signal on line 150.

The manner in which the signals on lines 42 or 44 are operative to control the shifting of values applied through line 54 to delay line 46 and circuitry for the delay line has been previously discussed.

Figure 4:
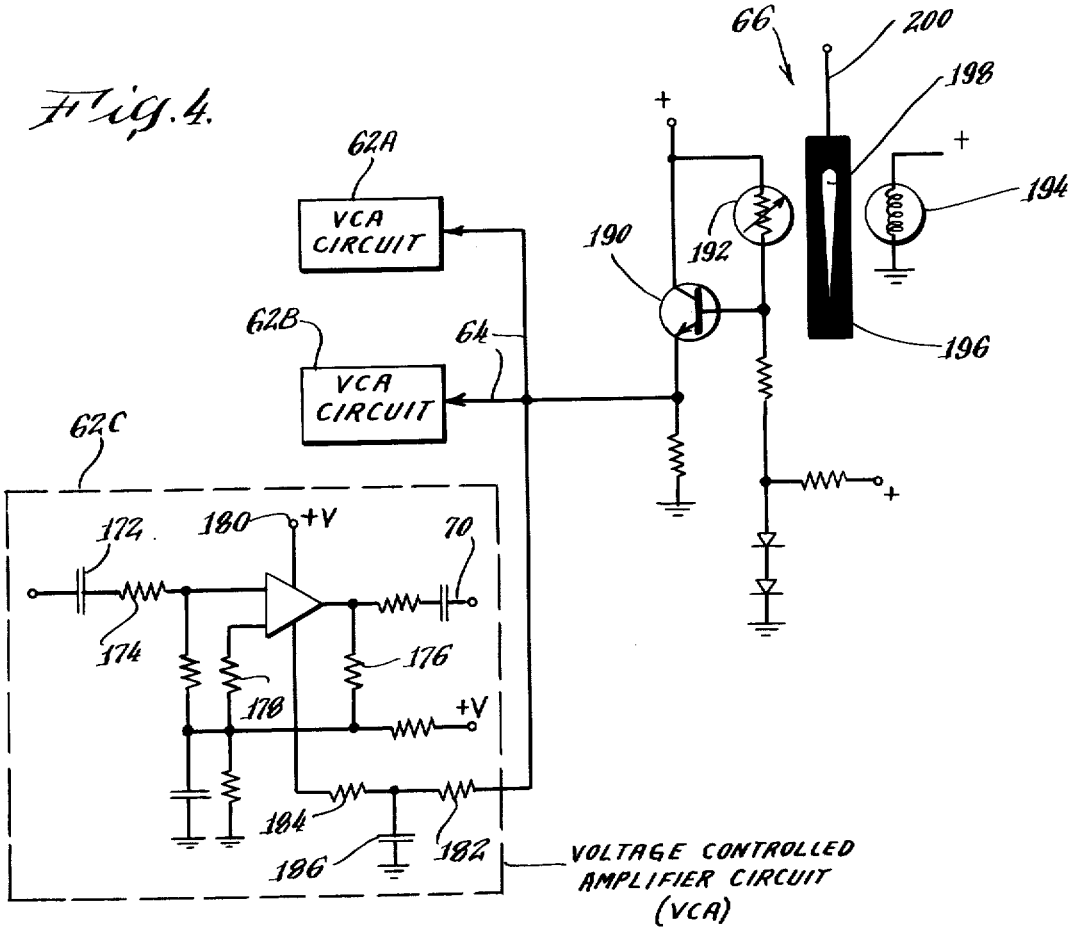
FIG. 4 is a semiblock schematic diagram of a voltage controlled amplifier and the variable photoelectric voltage control suitable for use in the embodiment of the invention shown in FIG. 1.

Referring now to FIG. 4, circuitry suitable for use in the VCA's 62 and variable photoelectric voltage source 66 are shown. Each VCA 62 consists of a standard operational transconductance amplifier 170, to one input of which the output from a chorus channel 10 is applied through capacitor 172 and resistor 174. Operating voltage for the amplifier is obtained from positive potential source 180 and the control potential for the amplifier is a voltage on line 64 which is applied to the bias current terminal (which allows the device to be gain controlled because the transconductance is directly proportional to the amplifier bias current), through resistors 182 and 184, a shunt path to ground through capacitor 186 being provided between these two resistors.

The control potential on line 64 is generated by variable photoelectric voltage source 66. This source has a transistor 190 connected as an emitter follower, the control potential applied to the base of transistor 190 being determined by the resistance of variable photoresistance device 192. This device may, for example, be a standard cadmium sulfide photocell. A light source 194, which may, for example, be a standard light emitting diode, or incandescent lamp is positioned to have its light impinge on photoresistive device 192, the amount of light which passes from source 194 to device 192 being controlled by mask 196 positioned therebetween. Mask 196 has a variable width slot 198 formed therein, the position of mask 196, and thus the width of slot 198 between 192 and 194 being controlled by an external device through shaft 200. Shaft 200 may, for example, be connected to the expression pedal of an organ or to some other comparable volume control element of the instrument. Thus, the control potential applied to all of the VCA circuits 62 may be varied by moving mask 196 in response to the operation of a player controlled volume device on the instrument.

Figure 6:
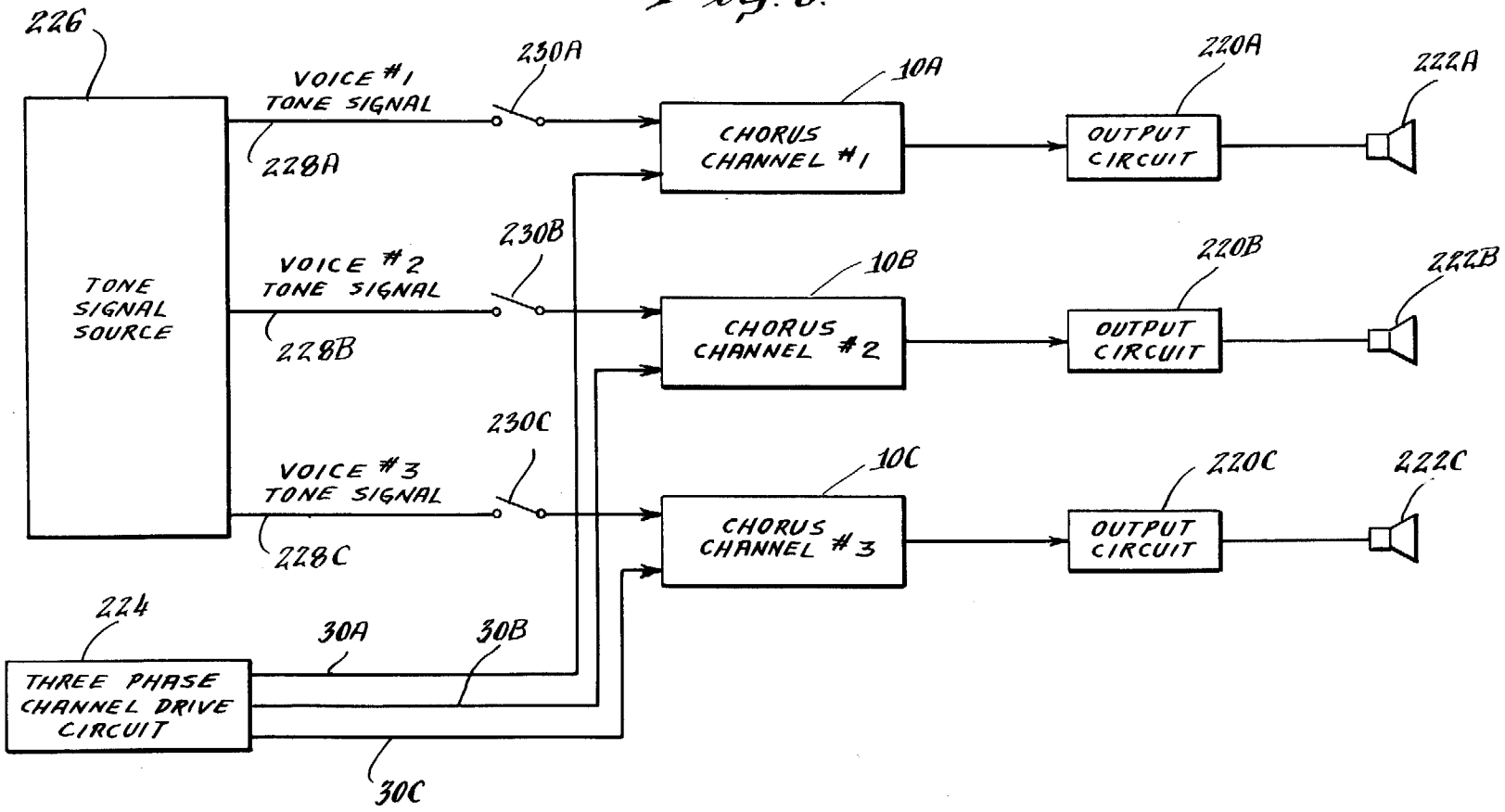
FIG. 6 is a schematic block diagram of a chorus effect generating circuit of an alternative embodiment of the invention.

FIG. 6 shows an alternative embodiment of the invention which is adapted to reproduce the sound of an ensemble made up of different musical instruments. For this embodiment of the invention, chorus channels 10A, 10B and 10C are provided, which channels may, for example, be the same as the chorus channels bearing the same numbers in FIG. 1. The outputs from each of these chorus channels are applied through separate output circuits 220, which may include amplifiers such as VCA's 62 shown in FIG. 1, to separate speakers or other output transducers 222. The phase modulation, which is imposed on tone signals applied to each chorus channel is determined by the frequency and phase of signals appearing on output lines 30 from three-phase channel drive circuit 224, each of the lines 30 being applied to a corresponding one of the chorus channels. Circuit 224 may, for example, include oscillators such as 12 and 16, counters such as 24 and 26 and related circuitry shown in FIG. 1 or may include other suitable circuitry.

The circuit of FIG. 6 also includes a tone signal source 226 which may be, for example, the tone generating circuitry, including the keying and voicing circuits, of any standard electronic organ. The outputs from source 226 are thus tone signals havin selected tonal characteristics, including selected voicing. The output on line 228A may thus, for example, be a tone signal having a flute voice, the output on line 228B may, for example, be a tone signal having a flute voice of a different pitch or a string voice, the output on line 228C may, for example, be a tone signal having a selected preset voice. Lines 228A, 228B and 228C are connected through switches 230A, 230B and 228C respectively as the tone signal inputs to chorus channels 10A, 10B and 10C.

Thus, with only one of the switches 230 closed, the circuit of FIG. 6 serves merely to add vibrato to a tone signal having a selected voice. With two or more of the switches 230 closed, a multi-instrument ensemble output is obtained, the different phase modulation in each of the channels assuring that the distinctiveness of the separate voices is maintained.

While for the preferred embodiments of the invention described above, three chorus channel circuits 10 have been utilized, it is apparent that a chorus effect can be obtained utilizing N channels, where N is an integral number greater than one. Counters 24 and 26 would each have N stages. It is also possible to connect line 54 directly as an output, as shown in FIG. 1, this output being either an additional channel as shown, or being utilized instead of one of the other channels. When line 54 is utilized as an output channel, the delays in the other channels are selected such that the outputs from these other channels are shifted in phase relative to the signal on line 54.

Further, while specific elements have been shown or suggested for each of the components of the circuit, it is apparent that elements adapted for performing an equivalent function could be substituted for each of the elements shown. Thus, while the invention has been particularly shown and described above with respect to a preferred embodiment thereof, the foregoing and other changes in form and detail may be made therein without departing from the spirit and scope of the invention.

What is claimed is:

1. In an electronic musical instrument, a circuit for producing a chorus effect comprising:

a source of tone signals;

N separate channels where N is an integer greater than one, each of said channels having an analog delay line;

means for applying a tone signal as an input to each of said delay lines; and means for generating clock pulses for said delay lines, the clock pulse variations for the delay lines of each channel being out of phase with those for each other channel by a selected amount, said means including first and second N stage counters, means for stepping said first counter at a first predetermined relatively low frequency and for stepping the second counter at a second frequency, the second frequency being several times greater than the first frequency, means for combining the output from each stage of the first counter with the output from a selected stage of the second counter and applying each of said combined outputs to a single line, a filter means for each channel, a voltage controlled oscillator for each channel, means for applying the combined output on each of said lines through a different one of said filter means to control the output frequency of the corresponding oscillator, and means for utilizing the output from each oscillator to produce the clock pulses for the corresponding delay line;

the outputs from said delay lines being utilized to produce a chorus effect output from said instrument.

2. A circuit as claimed in claim 1 including means for utilizing a tone signal directly in addition to the outputs from said delay lines to produce said chorus effect output.

3. A circuit as claimed in claim 1 wherein said means for combining combines outputs from corresponding stages of said counters.

4. A circuit as claimed in claim 1 wherein N is equal to three.

5. A circuit as claimed in claim 1 wherein said means for stepping said first and second N stage counters include oscillator circuits operating at said first predetermined frequency and said second predetermined frequency respectively.

6. A circuit as claimed in claim 5 wherein said means for stepping includes means for randomly varying the frequency of at least one of said oscillator circuits.

7. A circuit as claimed in claim 6 wherein said means for randomly varying varies the frequency of the lower frequency of said oscillator circuits.

8. A circuit as claimed in claim 5 wherein at least one of said oscillator circuits includes a capacitor, means for repetitively charging said capacitor at a predetermined rate, and means responsive to the charge across said capacitor reaching a predetermined level for permitting said capacitor to discharge and for generating a clock pulse, the frequency of the oscillator circuit being dependent on the rate at which said capacitor is charged.

9. A circuit as claimed in claim 8 including means for randomly varying the rate at which said capacitor is charged.

10. A circuit as claimed in claim 1 wherein the output from each of said oscillators is a relatively high frequency triangular wave; and wherein each of said means for utilizing the output from the oscillator to produce clock pulses includes means for utilizing only the peaks of said wave to produce two clock pulses per cycle which pulses are non-overlapping and 180° out of phase with each other.

11. A circuit as claimed in claim 10 wherein said means for utilizing only the peaks of said wave includes means for converting each cycle of said wave into two half-cycles of the same polarity, and means for passing only the peaks of each of said half cycles as drive pulses to separate inputs of said delay line.

12. A circuit as claimed in claim 1 wherein the output to each channel from said means for combining is a low frequency rectangular wave having a higher frequency rectangular wave superimposed thereon, each of said rectangular waves having duty cycles of (100%/N); and wherein the filter means for each channel includes means for converting each of said rectangular waves into a sine wave at substantially said low frequency having a sine wave at substantially said higher frequency superimposed thereon.

13. A circuit as claimed in claim 12 including a nonlinear circuit positioned between each of said filter means and the corresponding oscillator.

14. A circuit as claimed in claim 13 wherein said nonlinear circuit includes means for compensating for the non-linearity in the amount of delay necessary to smoothly frequency modulate the tone signal by equal musical intervals on each side of the tone signal frequency.

15. A circuit as claimed in claim 14 wherein said means for compensating includes means for causing the impedance to the output signal from said filter to be different when said signal is increasing in amplitude than when said signal is decreasing in amplitude.

16. A circuit as claimed in claim 1 including a separate voltage controlled amplifier (VCA) for each channel, the output from each of said delay lines being applied through the corresponding VCA; and means for applying a common control voltage to all of said VCA's.

17. A circuit as claimed in claim 16 wherein said instrument has a player operated amplitude control means; and wherein said means for applying a common control voltage includes a light source, a photoresistive device positioned to have the light from said source impinge thereon, means responsive to said amplitude control means for modulating the amount of light impinging on said photoresponsive device, and means responsive to the amount of light impinging on said photoresponsive device for controlling said control voltage.

18. A circuit as claimed in claim 1 wherein said source of tone signals provides only a single tone signal; and wherein said means for applying is operative to apply such single tone signal as an input to each of said delay lines.

19. A circuit as claimed in claim 1 wherein said source of tone signals produces at least two separate tone signals which signals have different tonal characteristics; and wherein said means for applying is operative to apply each of said tone signals to a different one of said delay lines.

20. A circuit as claimed in claim 19 wherein said source of tone signals produces N different tone signals, each of which has different tonal characteristics; and wherein said means for applying is operative to apply each of said tone signals to a corresponding one of said delay lines.

21. A circuit as claimed in claim 20 wherein said means for applying includes means selectively operative for preventing each of said tone signals from being applied to the corresponding delay line.

22. In an electronic musical instrument, a circuit for producing a chorus effect comprising:

a source of tone signals;

N separate channels where N is an integer greater than one, each of said channels having an analog delay line;

means for applying a tone signal as an input to each of said delay lines; and means for generating clock pulses for said delay lines, said means including a voltage controlled oscillator for each channel, means for generating a separate cyclicly varying control signal for each channel, each of said signals being out of phase with each of the other signals by a predetermined amount, said means for generating including means for randomly varying the phase relationship between the control signals for each channel means for applying each of said signals to control the output frequency of the corresponding oscillator, and means for utilizing the output from each oscillator to produce the clock pulses for the corresponding delay line;

the outputs from said delay lines being utilized to produce a chorus effect output from said instrument.

23. In an electronic musical instrument, a circuit for producing a chorus effect comprising:

a source of tone signals;

N separate channels where N is an integer greater than one, each of said channels having an analog delay line;

means for applying a tone signal as an input to each of said delay lines; and means for generating clock pulses for said delay lines, said means including a voltage controlled oscillator for each channel, the output from each of said oscillators being a relatively high frequency triangular wave, means for generating a separate sub-audio cyclicly varying control signal for each channel, each of said signals being out of phase with each of the other signals by a predetermined amount, means for applying each of said signals to control the output frequency of the corresponding oscillator, means for utilizing only the peaks of the output waves from each oscillator to produce two clock pulses per cycle which pulses are non-overlapping and 180 out of phase with each other, and means for applying said non-overlapping pulses as the clock pulses to the corresponding delay line;

the outputs from said delay lines being utilized to produce a chorus effect output from said instrument.

24. A circuit as claimed in claim 23 wherein said means for utilizing only the peaks of said wave includes means for converting each cycle of said wave into two half-cycles of the same polarity, and means for passing only the peaks of each of said half cycles as clock pulses to separate inputs of said delay line.

25. In an electronic musical instrument, a circuit for producing a chorus effect comprising:

a source of tone signals;

N separate channels where N is an integer greater than one, each of said channels having an analog delay line;

means for applying a tone signal as an input to each of said delay lines; and means for generating clock pulses for said delay lines, said means including a voltage controlled oscillator for each channel, means for generating a separate sub-audio sine wave signal having a higher frequency sine wave signal superimposed thereon for each channel, each of said signals being out of phase with each of the other signals by predetermined amounts, a nonlinear circuit, means for applying each of said signals to said nonlinear circuit means for applying the output of said nonlinear circuit to control the output frequency of the corresponding oscillator, and means for utilizing the output from each oscillator to produce the clock pulses for the corresponding delay line;

the outputs from said delay lines being utilized to produce a chorus effect output from said instrument.

26. A circuit as claimed in claim 25 wherein said nonlinear circuit includes means for compensating for the nonlinearity in the amount of delay necessary to smoothly frequency modulate the tone signal by equal musical intervals on each side of the tone signal frequency.

27. A circuit as claimed in claim 26 wherein said means for compensating includes means for causing the impedance of the nonlinear circuit to be different when the amplitude of signal applied thereto is increasing then when the amplitude of the signal is decreasing.

28. In an electronic musical instrument having a player operated amplitude control means and at least two separate channels through which one or more tone signals may be applied to produce a chorus effect, a volume control circuit comprising:

a separate voltage controlled amplifier (VCA) for each channel;

means for applying the output from each channel through the corresponding VCA; and means for applying a common control voltage to all of said VCA's, said means including a light source, a photoresistive device positioned to have the light from said source impinge thereon, means responsive to said player operated amplitude control means for modulating the amount of light impinging on such photoresistive device, and means responsive to the amount of light impinging on the photoresistive device for controlling said control voltage.

29. A circuit as claimed in claim 28 wherein said player operated amplitude control means is an expression pedal; and wherein said means for modulating the amount of light is a mask having a variable width slot which is attached to be moved by said expression pedal to permit varying amounts of light to pass from said source to said photoresponsive device.

30. A circuit for generating two separate sets of clock pulses to control the delay in a bucket brigade analog delay line, the pulses in one set being of the same polarity, non-overlapping, and 180° out of the phase with the pulses in the other set, said circuit comprising;

a voltage control oscillator, the output from said oscillator being a relatively high frequency triangular wave having for each cycle, a positive and a negative half cycle;

means for applying a voltage to said oscillator to control the output frequency thereof; and means for utilizing only the peaks of one-half cycle of said triangular wave to produce one of said sets of clock pulses and only the peaks of the other half cycle of said triangular wave to produce the clock pulses of the other set of clock pulses.

31. In an electronic musical instrument, a circuit for producing a chorus effect comprising:

N separate delay line channels where N is an integer greater than one;

means for producing at least two separate tone signals, said signals having different tonal characteristics;

means for selectively applying each of said tone signals to a different one of said delay line channels; and means for independently phase modulating the tone signals applied to each of said channels;

the outputs from said channels being utilized to produce a chorus effect output from said instrument.

32. A circuit as claimed in claim 31 wherein said means for producing tone signals produces N tone signals each having different tonal characteristics; and wherein said means for applying includes means for applying each of the said tone signals to a different one of said delay line channels.

33. A circuit as claimed in claim 32 wherein said means for applying includes means for selectively controlling the tone signal applied to at least one of said channels.

34. A circuit is claimed in claim 33 wherein said means for selectively controlling includes means for selectively preventing a tone signal from being applied to at least one of said channels.

* * * * *